United States Patent [19]

Corbiere

[11] Patent Number: 5,027,988

[45] Date of Patent: Jul. 2, 1991

[54] PROCESS FOR THE PRODUCTION OF PLEATED FABRICS, AND NEW PLEATED FABRICS FROM A SPIRAL TUBE

[75] Inventor: Claude Corbiere, La Tour de Salvagny, France

[73] Assignee: Corbiere S.A., France

[21] Appl. No.: 386,360

[22] Filed: Jul. 27, 1989

[30] Foreign Application Priority Data

Jul. 28, 1988 [FR] France ..... 88 10448

[51] Int. Cl.[5] ..... A41D 27/24

[52] U.S. Cl. ..... 223/28; 223/29; 112/63; 493/299; 493/440

[58] Field of Search ..... 223/28, 29, 30, 31, 223/32; 112/427, 63; 28/142; 26/21; 493/299, 440, 447, 463

[56] References Cited

U.S. PATENT DOCUMENTS 1,828,554 10/1931 Bunker ..... 112/63
2,415,824 2/1947 Katz ..... 112/63
4,660,261 4/1987 Corbiere ..... 223/28

FOREIGN PATENT DOCUMENTS 7724133 7/1977 France .
109719 3/1962 Norway ..... 223/28
571397 8/1945 United Kingdom .

*Primary Examiner*—Werner H. Schroeder
*Assistant Examiner*—Bibhu Mohanty
*Attorney, Agent, or Firm*—Wall and Roehrig

[57] ABSTRACT

A process for the production of a pleated textile fabric, which comprises first forming a spiral tube from a plane fabric by joining together the two selvedges of said fabric; then in known manner pleating this spiral tube and fixing the pleats thus formed; and finally undoing the join connecting the two selvedges of the fabric.

The invention relates also to a weft and warp woven pleated fabric wherein the pleats are disposed on the bias and the weft threads are inclined.

6 Claims, 2 Drawing Sheets

PROCESS FOR THE PRODUCTION OF PLEATED FABRICS, AND NEW PLEATED FABRICS FROM A SPIRAL TUBE

FIELD OF THE INVENTION

The present invention relates to an improved process permitting the production of pleated textile fabrics; it also concerns a new pleated woven fabric.

Pleated fabrics, such as woven materials, knitted materials and nonwovens, which products will in the remainder of the description and in the claims be referred to as "fabrics", are well known and widely used for making clothing (skirts, dresses and so on) and for furnishings (curtains, sheer curtains and so on).

PRIOR ART

Various processes are known for producing pleated fabrics. These processes consist essentially in folding the fabric over itself to an extent corresponding to the width of the pleats desired, flattening these pleats, and then applying a fixing treatment to give permanence to the pleats formed. The pleats are most generally disposed substantially at right angles to the length direction of the fabric. In the document FR-A-2 398 830 a widely used process was proposed which is economical and effective for the continuous production of articles pleated in the length direction, this being done continuously, without dead time or stoppages in the production cycle.

When it is desired to effect pleating on the bias of the fabric, the only practical solution consists in cutting out pieces of cloth of small dimensions and then inserting them on the bias into the pleating machine. A process of this kind can be applied only to pieces of fabric of small dimensions, such as for example scarves, because a limitation is then imposed by the available width of the pleating machine, which at the present time attains in practice a maximum of 150 centimeters.

So-called "bias cutting" devices have also been proposed, which make it possible for a standard fabric to be continuously converted into "bias" by sewing edge to edge and at the same time cutting into pieces at right angles to the seam thus formed. This amounts to joining together, by sewing, strips cut on the bias from the fabrics.

It would have been possible to contemplate combining the teachings of the process described in document FR-A-2 398 830, referred to above, with this technique. Good results would have been obtained in respect of pleating, but fabrics formed in this way would nevertheless contain seams which would mar the fabric and impair its mechanical characteristics. In addition, the decoration of the fabric would above all not match in the seam areas, so that this combination is in practice ruled out for industrial purposes.

SUMMARY OF THE INVENTION

The present invention alleviates these drawbacks.

It relates to a process which enables bias pleating to be formed in a fabric, particularly a woven fabric, continuously, economically and in an effective manner.

The process according to the invention for the production of a pleated textile fabric is characterized in that it comprises:

first forming a spiral tube from a plane fabric by joining together the two selvedges of said fabric into a spiral seam, flattening the tube to form a double layer plane of fabric, then in known manner pleating this flattened spiral tube and fixing the pleats thus formed, and finally undoing the seam connecting together the two selvedges of the fabric.

Depending on the inclination of the spiral formed (this angle being hereinafter referred to as alpha), a process of this kind makes it possible to obtain at will a different inclination in the bias pleats in the direction of the fabric. Thus, if the pleating is effected in the direction of the length of the spiral tube formed (FIG. 2), after unstitching the finished fabric will have pleats extending transversely to the selvedges and inclined relative to the latter in dependence on the pitch of the spiral. On the other hand, if the pleating is effected in the transverse direction of the spiral tube formed (FIG. 3), a pleated article having a reversal effect will be obtained i.e., pleats on either side of the flat fold will be oppositely directed.

It is advantageous in practice for the fabric to be a weft and warp woven fabric containing thermoplastic threads (polyamide, polyester, triacetate or the like, or silk);

for the two selvedges to be joined together by sewing; this sewing is generally advantageously done edge to edge or with folded edges; it is also possible to use other techniques, such as welding or the adhesive bonding of the two selvedges to one another;

for the pleating to be effected in conventional manner after the spiral tube formed has been flattened;

for the pleating to be effected by subjecting the spiral tube to tension along the longitudinal axis of the tube, while at the same time subjecting it to transverse compression and to thermal fixing (the so-called "Fortuni" technique);

for the pleating to be effected in the longitudinal direction of the flattened spiral tube;

for the pleating to be effected in the transverse direction of the flattened spiral tube;

for the separation of the selvedges to be effected by cutting or by any other known means, such as slitting, cutting a strip straddling the seam, unstitching, labile thread, and so on.

BRIEF DESCRIPTION OF THE DRAWINGS

The manner in which the invention can be applied and the advantages which it furnishes will emerge more clearly from the examples of embodiment given below with reference to the accompanying drawings.

DESCRIPTION OF THE PREFERRED EMBODIMENT

Figure 1:
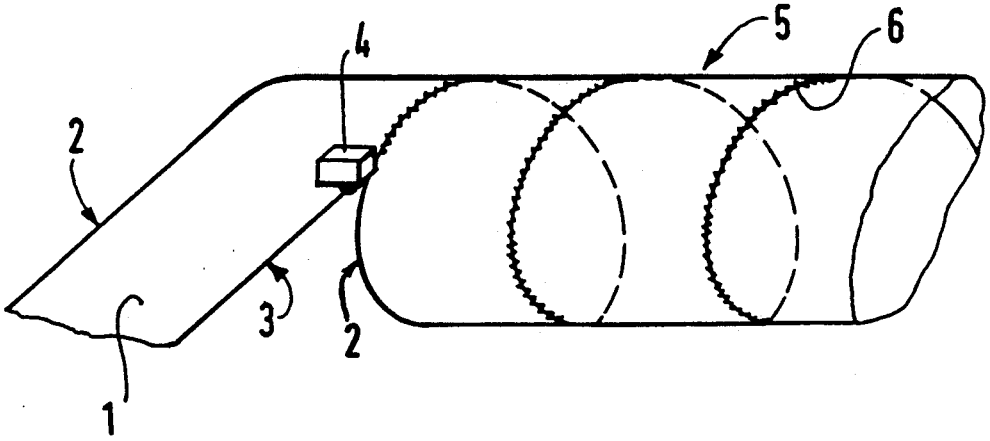
FIG. 1 is a simplified schematic view in perspective illustrating the manner in which the spiral tube according to the invention can be formed.

A woven fabric 1, which has two selvedges, namely the left-hand selvedge 2 and the right-hand selvedge 3, is converted into a spiral tube 5 by sewing with the aid of a conventional sewing machine 4 the selvedges 2, 3 which are presented in a helix and stitched together edge to edge.

Figure 2:
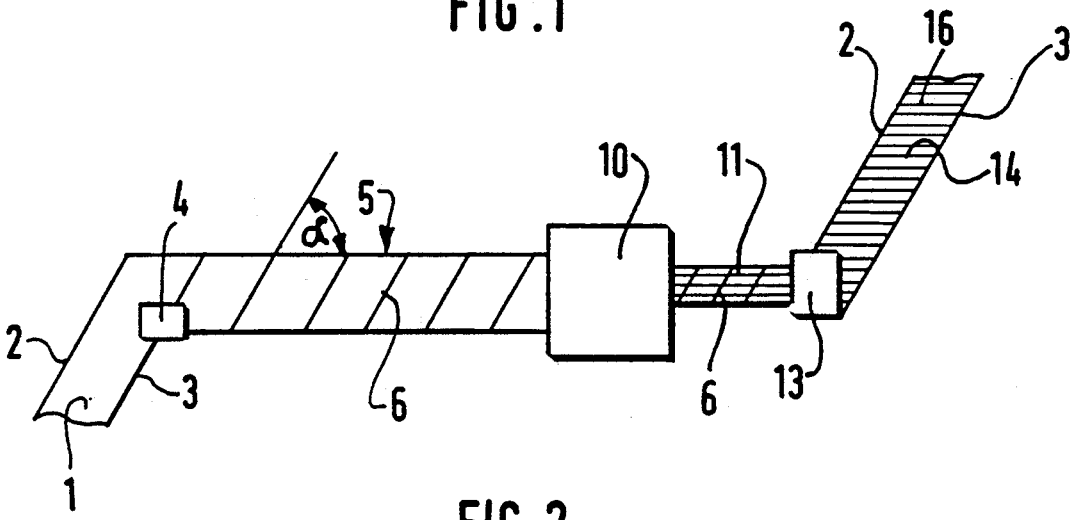
FIG. 2 illustrates, likewise schematically, a continuous operating process in which the spiral tube is pleated longitudinally.
Figure 3:
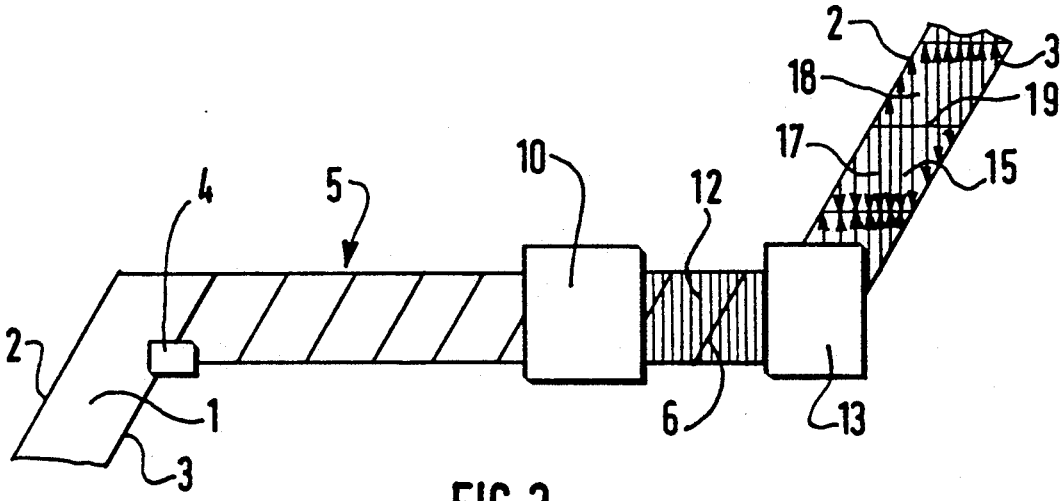
FIG. 3 shows a similar continuous operating process for transverse pleating.

After the sewing 6, the spiral tube 5 formed is introduced into a conventional pleating machine 10 (see FIGS. 2 and 3). As is known, the thermal fixing stage may take place in the actual pleating machine 10, advantageously during and simultaneously with the pleating. In a first embodiment, shown in FIG. 2, the machine 10 effects lengthwise pleating and a pleated tubular spiral 11 is obtained. Transverse pleating may also be effected to obtain a pleated tube 12 (see FIG. 3).

The pleated tubes 11, 12 are then brought to a station 13 in which the sewn edges 2, 3 of the pleated tube 11, 12 are separated. After the sewing 6 has been undone, pleated products 14 and 15 respectively are obtained. When the pleating was effected longitudinally (FIG. 2), the pleats 16 are directed on the bias relative to the selvedges 2, 3 of the woven fabric. On the other hand, when the pleating was effected transversely (FIG. 3), the pleats 17, 18 are directed alternately in one direction 17 and then in the other 18, but always on the bias, the two directions 17, 18 being clearly separated by a fold 19, thus producing reversal effects.

By controlling the inclination axis alpha of the spiral tube 5, it is possible to modify the inclination of the pleats 16, 17, 18 in the woven fabric.

In a preferred version, the fabric is, as already stated, a weft and warp fabric containing thermoplastic threads and the pleating is effected by the "Fortuni" method, that is to say by subjecting the spiral tube 5 to tension along its longitudinal axis and at the same time to transverse compression and thermal fixing.

Figure 4:
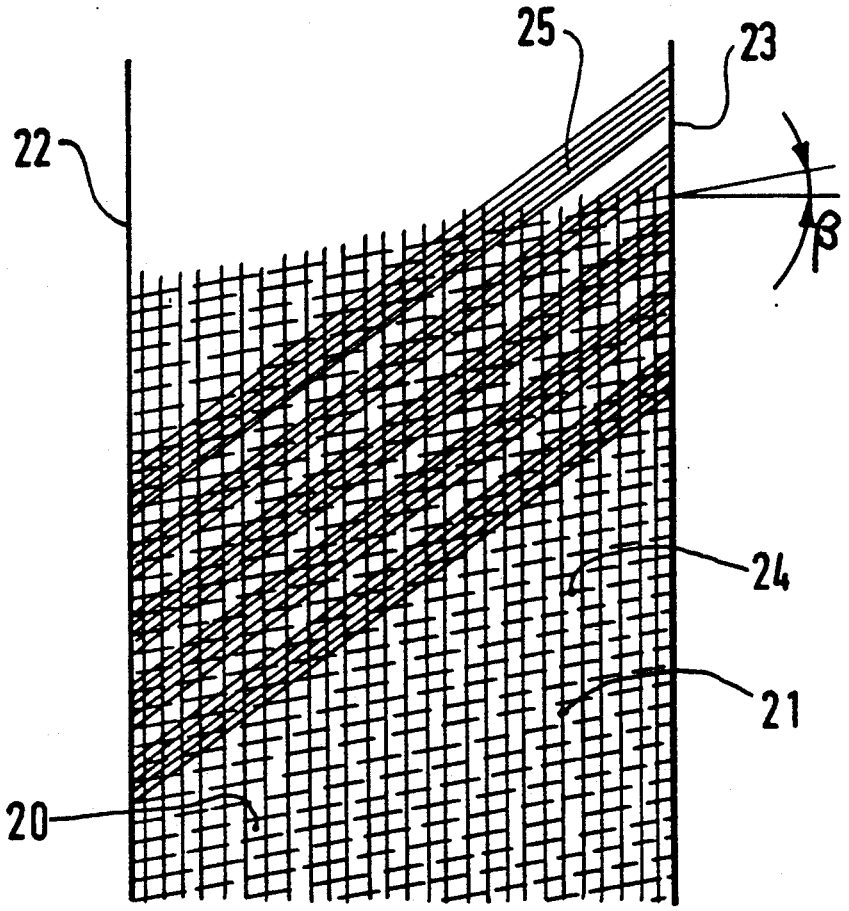
FIG. 4 shows a sample of bias pleated woven fabric according to the invention.

Unexpectedly, a woven fabric is obtained, which is shown in FIG. 4, where it is given the general reference 20, which comprises warp threads 21 bordered by two selvedges 22 and 23 respectively and connected together by weft threads 24. The reference 25 designates the bias pleats.

According to the original features of the invention the network comprising the warp 21 and weft 24 is deformed obliquely (and is therefore no longer at right angles) in the pleating, and the weft threads 24 are then inclined at a regular angle relative to the perpendicular to the selvedges 22, 23 and relative to the perpendicular to the axis of the fabric 20. This axis of inclination beta may vary within wide limits in dependence on the nature of the original woven fabric, the angle alpha of the sewing of the spiral tube 5, and the tension and compression applied during the pleating treatment.

This weft and warp woven fabric 20 is characterized at one and the same time in that:

the pleats 25 are on the bias relative to the selvedges 22, 23, and the weft threads 24 are also inclined regularly in relation to said selvedges.

This is a new, original characteristic which gives rise to a very supple pleated woven fabric.

The process of the invention is applicable to all types of fabric, particularly to woven fabrics of a simple weave which are intended for furnishings and clothing.

I claim:

1. A process for the production of a pleated textile fabric, which comprises:

forming a spiral tube from a plane fabric by creating a joint between two selvedges of said fabric;

pleating the said spiral tube and fixing the pleats thus formed; and undoing the joint connecting the two selvedges of the fabric.

2. A process according to claim 1, wherein the fabric is a weft and warp fabric containing thermoplastic threads.

3. A process according to claim 1, wherein the two selvedges are joined together by sewing a seam between two selvedges.

4. A process according to claim 2, wherein the spiral tube is flattened and then is pleated in the transverse direction of the flattened spiral tube.

5. A process according to claim 2, wherein the pleating is effected by subjecting the spiral tube to tension along the longitudinal axis of the tube, while at the same time subjecting it to transverse tension and to thermal fixing.

6. A process according to claim 3, wherein the separation of the selvedges is effected by cutting the seam.

* * * * *